US007025296B2

(12) United States Patent
Nonomura

(10) Patent No.: US 7,025,296 B2
(45) Date of Patent: Apr. 11, 2006

(54) TAPE CASSETTE AND TAPE UNIT

(75) Inventor: Yoshihito Nonomura, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 13 days.

(21) Appl. No.: 10/399,534

(22) PCT Filed: Sep. 27, 2001

(86) PCT No.: PCT/JP01/08412

§ 371 (c)(1),
(2), (4) Date: Apr. 18, 2003

(87) PCT Pub. No.: WO02/32682

PCT Pub. Date: Apr. 25, 2002

(65) Prior Publication Data

US 2004/0031875 A1 Feb. 19, 2004

(30) Foreign Application Priority Data

Oct. 19, 2000 (JP) ..... 2000-319077
Nov. 8, 2000 (JP) ..... 2000-340165

(51) Int. Cl.
*B65H 75/00* (2006.01)

(52) U.S. Cl. ..... 242/348; 400/242; 400/613

(58) Field of Classification Search ..... 242/348, 242/348.3, 570, 344, 912; 400/208, 242, 400/613, 615.2
See application file for complete search history.

(56) References Cited

U.S. PATENT DOCUMENTS

| | | | | |
|---|---|---|---|---|
| 4,367,963 A | | 1/1983 | Daughters | |
| 4,402,619 A | | 9/1983 | Paque et al. | |
| 5,056,940 A | * | 10/1991 | Basile | 400/235.1 |
| 5,499,877 A | * | 3/1996 | Sakanishi et al. | 400/193 |
| 5,618,119 A | * | 4/1997 | Misu et al. | 400/208 |
| 5,620,268 A | | 4/1997 | Yamaguchi et al. | |
| D474,192 S | * | 5/2003 | Nonomura | D14/483 |
| D475,060 S | * | 5/2003 | Nonomura | D14/483 |
| D475,717 S | * | 6/2003 | Nonomura | D14/484 |
| D477,607 S | * | 7/2003 | Nonomura | D14/483 |
| D483,772 S | * | 12/2003 | Nonomura | D14/484 |

FOREIGN PATENT DOCUMENTS

| | | |
|---|---|---|
| EP | 0 633 141 A2 | 1/1995 |
| EP | 0 635 375 A2 | 1/1995 |
| EP | 0 704 311 A2 | 4/1996 |
| EP | 0 919 393 A1 | 6/1999 |
| JP | A-7-1782 | 1/1995 |
| JP | A 7-25123 | 1/1995 |
| JP | A-7-32709 | 2/1995 |
| JP | A-8-165035 | 6/1996 |

* cited by examiner

*Primary Examiner*—John Q. Nguyen
(74) *Attorney, Agent, or Firm*—Oliff & Berridge, PLC

(57) ABSTRACT

A tape unit has a support including a rotation support section rotatably supporting a tape spool and facing a roll part of a print tape, and a junction section extending from the rotation support section. A guide groove for guiding the print tape pulled out from the roll part is formed on the junction section. By virtue of such composition, the tape unit can be attached to a cassette case body of a tape cassette maintaining the print tape in the guide groove, by which the replacement of the tape unit which is stored in the cassette case body can be made easier.

4 Claims, 7 Drawing Sheets

TAPE CASSETTE AND TAPE UNIT

TECHNICAL FIELD

The present invention relates to the composition of a tape cassette which is used for a tape printing device for creating lettered tapes (tapes having characters such as letters printed thereon) and the composition of a tape unit (including a print tape rolled up around a tape spool) which is exchangeably loaded in a cassette case body of the tape cassette, and in particular, to the composition of the tape unit and the tape cassette by which the replacement of the tape unit can be made easily.

BACKGROUND OF THE INVENTION

In consideration of the purpose of use of lettered tapes created by use of the tape printing device it becomes necessary to employ multiple types of print tapes having different tape widths. Meanwhile, from the viewpoint of resource saving, it is desirable that the cassette case can be reused when the print tape in the cassette case is used up. A tape cassette proposed by the present inventors in Japanese Patent Provisional Publication No. HEI07-25123 in consideration of the above requests was designed to have the following composition and strong points: When the print tape in the cassette case is used up, an empty tape unit (whose print tape has run out) stored in the cassette case body can be replaced with a new tape unit to which a brand-new print tape has been set. Multiple types of tape units corresponding to multiple types of print tapes of different tape widths can be stored in a cassette case body of a single type. For this, each tape unit is provided with a tape width differentiation member.

DISCLOSURE OF THE INVENTION

In the above conventional cassette case however, the tape spool of the print tape was rotatably supported from upward nearby the tape width differentiation member. Therefore, for attaching the tape unit to the tape cassette, the tape unit had to be tilted with the tape being placed under the tape width differentiation member, and the tape unit had to be set to the tape cassette while guiding the end of the tape into a guide groove of the tape cassette.

However, the above tape attachment procedure (tilting the tape unit with the tape being placed under the tape width differentiation member and setting the tape unit to the tape cassette while guiding the tape end into the guide groove of the tape cassette) used to be a little complicated and difficult to the user.

The present invention, which has been made in order to resolve the above problems, aims to provide a tape cassette and its tape unit by which the replacement of the tape unit stored in the cassette case body can be made with extreme ease.

In accordance with an aspect of the present invention, in a tape cassette to be used for a tape printing device in which a tape unit having a print tape rolled up around a tape spool is exchangeably stored in a cassette case body, the tape unit is provided with a support including: a rotation support section which rotatably holds the tape spool and faces the roll part of the print tape; and a junction section which extends from the rotation support section, and a guide section for guiding the print tape pulled out from the roll part is formed on the junction section.

BEST MODE FOR CARRYING OUT THE INVENTION

Figure 1:
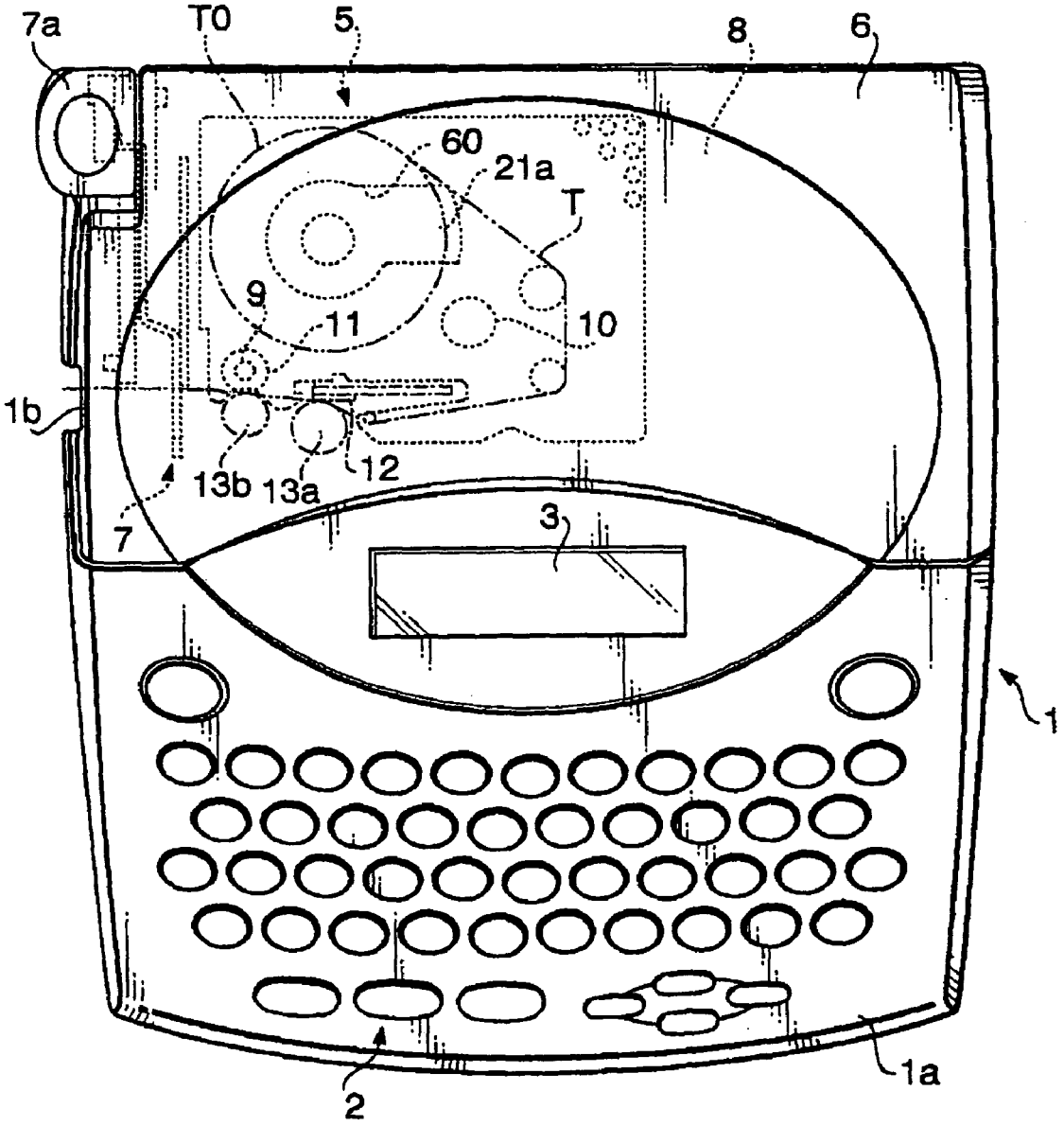
FIG. 1 is a plan view showing a tape printing device with the cover of its tape cassette storage section closed.

Referring now to the drawings, a description will be given in detail of preferred embodiments in accordance with the present invention. FIG. 1 is a plan view showing a tape printing device 1 with the cover 6 of its cassette storage section 8 closed.

Referring to FIG. 1 the upper surface of the body 10 of the tape printing device 1 is provided with: a keyboard section 2 having character input keys (for inputting characters such as letters for one or more lines and thereby generating a text which is composed of document data (code data)), a print key (for instructing the device to print the text), cursor keys (for moving a cursor horizontally and vertically on a liquid crystal display 3), control keys (for inputting instructions for starting new lines, executing processes making selections, etc.); the liquid crystal display 3 for displaying characters (letters etc.) inputted from the keyboard section 2; and the cassette storage section 8 which stores a tape cassette 5 which will be explained later. The cover 6 for covering the cassette storage section 8 is supported at the rear end of the body 1*a* so that the cover can be opened and closed. As shown in FIG. 1, a tape cutter 7 for cutting a printed tape being ejected from an outlet 1*b* of the body 1*a* is placed at the left of the cassette storage section 8. An operation button 7*a* for the tape cutter 7 is placed at the rear end of the left side face of the body 1*a*.

In the cassette storage section 8, a ribbon roll-up spindle 10 and a tape feed roller spindle 9 are erected, which are driven and rotated by a tape feed motor (unshown) installed in the body 1*a* via proper driving mechanisms (unshown). Incidentally, while such a ribbon roll-up spindle is generally used for rolling up an ink ribbon in conventional tape cassettes (which are used for printing letters etc. on a film tape by use of the ink ribbon loaded therein), in the tape cassette 5 of this embodiment, the ribbon take-up spindle 10 does not take part in the print tape feeding operation since the tape cassette 5 does not include the ink ribbon nor its roll-up spool but employs a print tape T having a thermosensitive coloring property on which letters etc. can be printed without the use of an ink ribbon.

The tape feed roller spindle 9, placed obliquely in front of the ribbon roll-up spindle 10 (that is, placed near to the keyboard section 2), is erected so as to be fit in and engaged with a tape feed roller 11 of the tape cassette 5. In front of the cassette storage section 8, a thermal head 12 for carrying out the printing of characters (letters etc.) on the print tape T is installed. Further, a platen roller 13*a* and a tape feed auxiliary roller 13*b* for pressing the print tape T against the thermal head 12 and the tape feed roller 11 respectively are mounted on a roller holder (unshown) which is capable of moving toward and away from the tape cassette 5.

The rear part of the cassette storage section 8 (in the upper right-hand part of FIG. 1) is equipped with a tape type detection section (unshown) which includes seven microswitches (unshown) for detecting the type, width, etc. of the print tape T. The tape type detection section works in cooperation with tape detection parts 50*a* and 50*b* of the tape cassette 5 and a tape identification section 30 of a tape unit 20 which will be explained later, and thereby determines the width and type (color, transparent/semitransparent, possible colors of characters, material, etc.) of the print tape T stored in the tape cassette 5.

Specifically, the type (tape width etc.) of the print tape T is detected based on the combination of ON/OFF signals which are outputted by the aforementioned microswitches each of which detects whether each blocking part 51 (to be explained later) comes in and makes contact with the microswitch. Incidentally, instead of the microswitches, optical sensors (photosensors etc.) magnetic sensors, etc. can also be employed for the tape type detection section.

The tape printing device 1 having the above composition is controlled by an electronic controller such as a microcomputer including a CPU, ROM, CGROM, RAM, buses, etc. The ROM stores various programs (print control program etc.) for the control of the tape printing device 1. The CPU carries out various operations based on programs stored in the ROM. In the ROM, outline data specifying the outline of each of a lot of characters (letters etc.) are also stored being classified into fonts (Gothic type, Ming-style type, etc.) and being associated with corresponding code data. Dot pattern data is spread out in an image buffer according to the outline data.

The CGROM stores the dot pattern data corresponding to each character inputted from the keyboard section 2. The dot pattern data corresponding to the inputted character is read out from the CGROM and a dot pattern is displayed on the liquid crystal display 3 based on the dot pattern data. The RAM is used for temporarily storing the results of various operations carried out by the CPU, in which some special-purpose memory units (text memory, image buffer, print buffer, etc.) are prepared.

The keyboard section 2, the aforementioned tape type detection section (for detecting the width of the print tape T), the liquid crystal display 3 and a display controller are connected to the aforementioned controller via input/output interfaces. When characters are inputted by use of the character input keys of the keyboard section 2, document data corresponding to the inputted characters are successively stored in the text memory, while dot patterns corresponding to the inputted characters are successively displayed on the liquid crystal display 3 according to a dot pattern generation program and a display control program. The thermal head 12 driven by an unshown driving circuit, performs the printing of the dot pattern data transferred from the image buffer to the print buffer. In sync with the tape printing operation by the thermal head 12, the tape feed motor driven by the driving circuit carries out feeding control for the print tape T.

Figure 2:
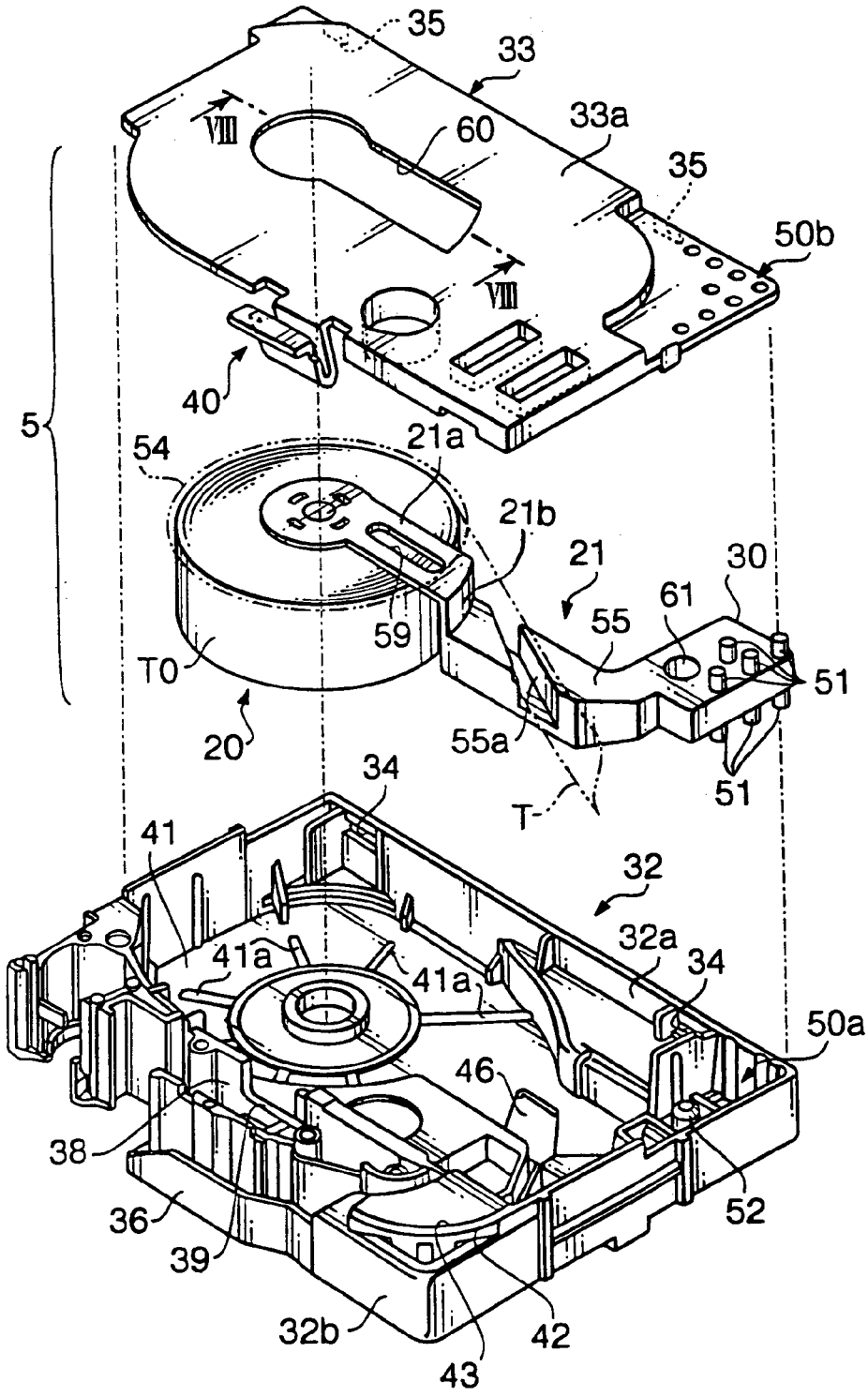
FIG. 2 is an exploded perspective view of a tape cassette in accordance with an embodiment of the present invention.
Figure 3:
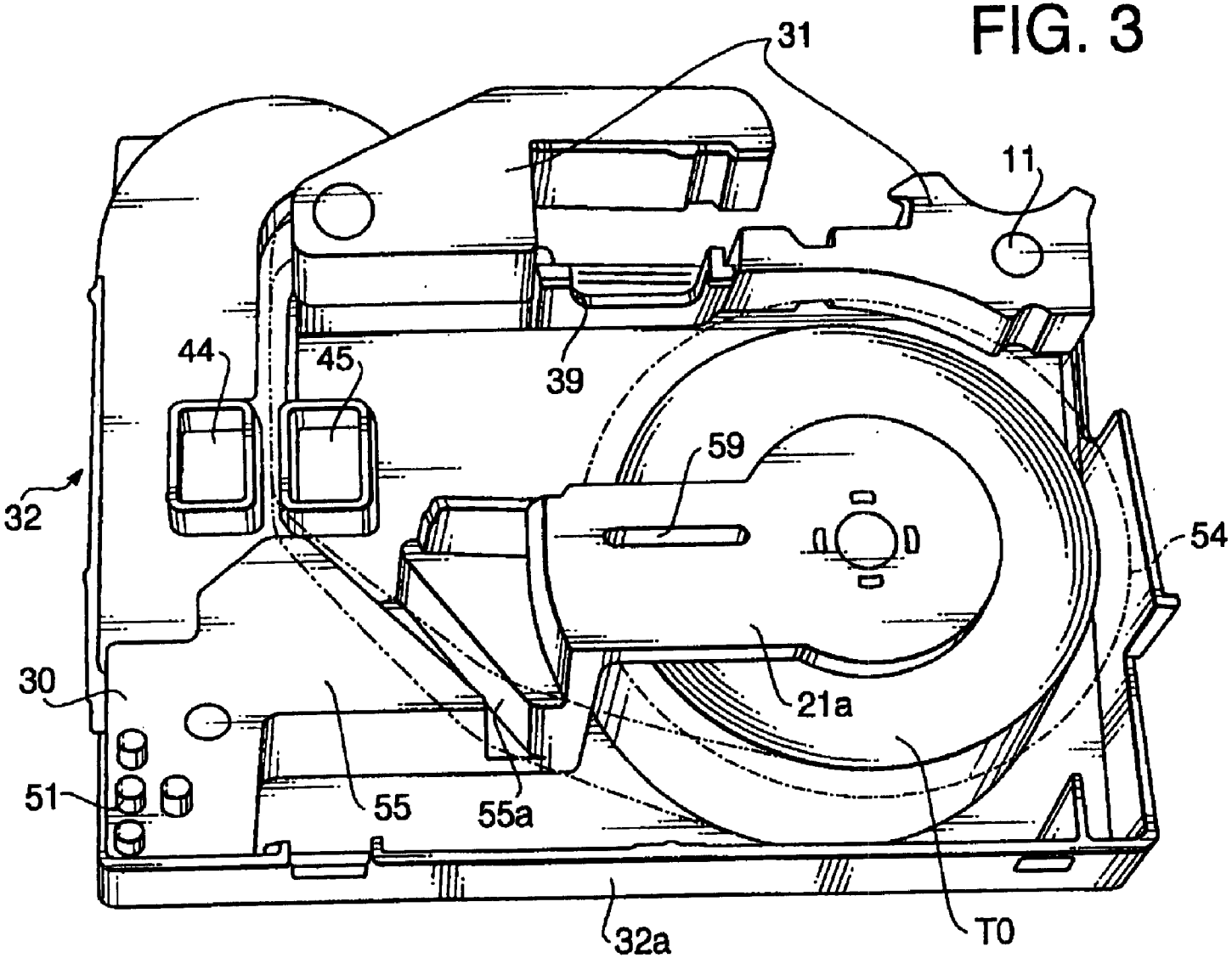
FIG. 3 is a perspective view of the tape cassette with its cassette cover removed and with a tape unit stored therein.

In the following, the composition of the tape cassette 5, which is stored in the cassette storage section 8 of the tape printing device 1 composed as above, will be explained with reference to FIGS. 2 through 9. FIG. 2 is an exploded perspective view of the tape cassette 5, and FIG. 3 is a perspective view of the tape cassette 5 with its cassette cover 33 removed and with the tape unit 20 stored therein. The tape cassette 5 is basically composed of a cassette case body 32, the cassette cover 33 which is detachably attached to the cassette case body 32, and an auxiliary cover block 31 for covering parts in the cassette case body 32 (such as a tape feed section including a tape pull-out section 36, the tape feed roller 11, etc.) that are not covered by the cassette cover 33. Each component is formed of synthetic resin by means of injection molding.

The cassette case body 32 is made of a boxy cas without its top, and its rear wall 32*a* is provided with a pair of latch holes 34 at both ends. With the latch holes 34, latches 35 protruding downward from the trailing edge of the cassette cover 33 (to be explained in detail later) are engaged.

The tape pull-out section 36, stretching to the left from the right-hand side of the front wall 32*b* of the cassette case body 32, is formed integral with the cassette case body 32, and a thermal head guide section 37 is formed integrally behind the tape pull-out section 36. The thermal head guide section 37 is formed in the shape of the letter "U" (as seen in a plan view), and the thermal head 12 is placed inside the U-shaped concavity 38. The rear wall of the U-shaped concavity 38 is provided with a latch slot 39, with which an elastic hook 40 (see FIGS. 2 and 4A) formed on the cassette cover 33 (which will be explained in detail later) will be engaged. The tape feed roller 11 (see FIGS. 1 and 4B), capable of engaging with the tape feed roller spindle 9 erected from the bottom of the cassette storage section 8 of the tape printing device 1, is placed between the thermal head guide section 37 and the left side wall of the cassette case body 32. Incidentally, the tape feed roller 11 and the auxiliary cover block 31 are not shown in FIG. 2 for clearly displaying the configuration of the front part of the cassette case body 32 including the latch slot 39.

In the left rear part of the cassette case body 32 a tape unit storage section 41 (see FIGS. 2 and 4B) is formed for accommodating and storing the tape unit 20. A roll part T0 (tape roll) of the tape unit 20 is rotatably stored in the tape unit storage section 41.

Figure 4A:
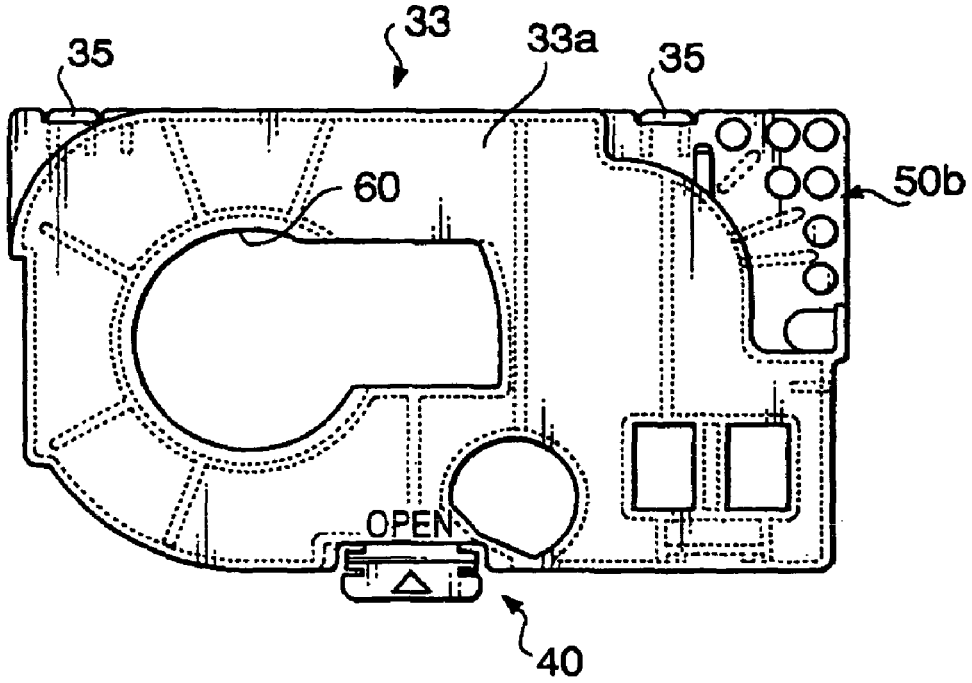
FIG. 4A is a plan view of the cassette cover.
Figure 4B:
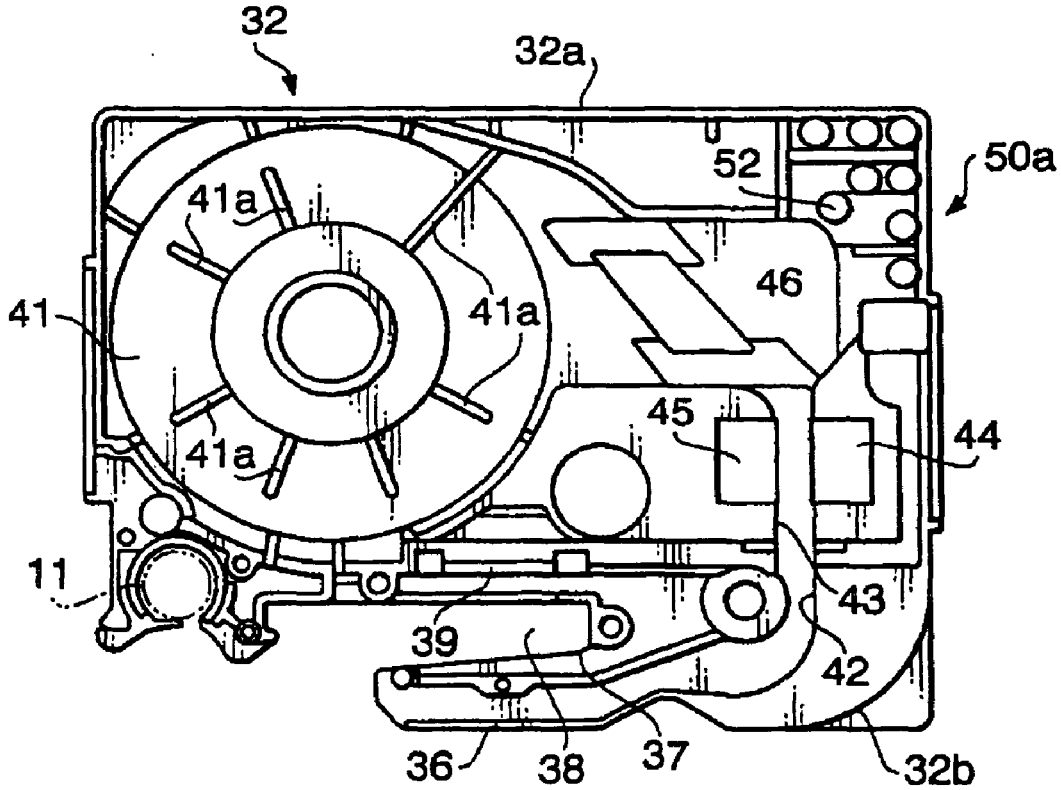
FIG. 4B is a plan view of a cassette case body of the tape cassette.
Figure 5A:
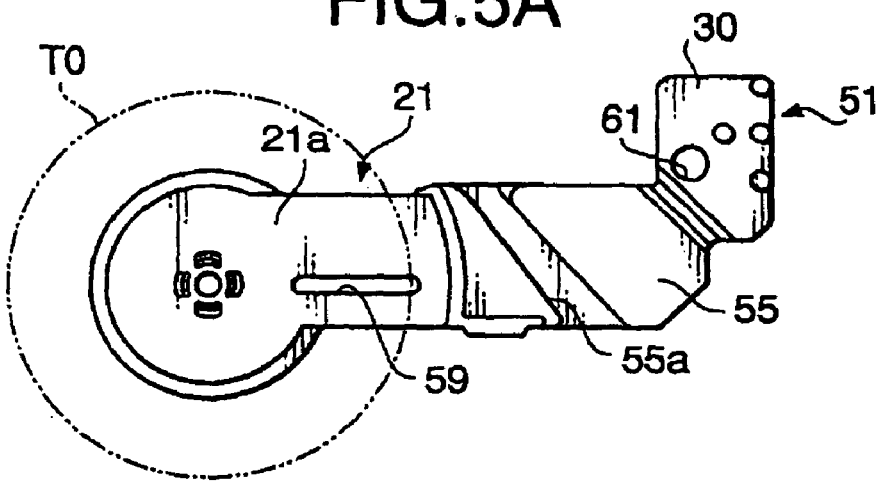
FIG. 5A is a plan view of the tape unit.
Figure 5B:
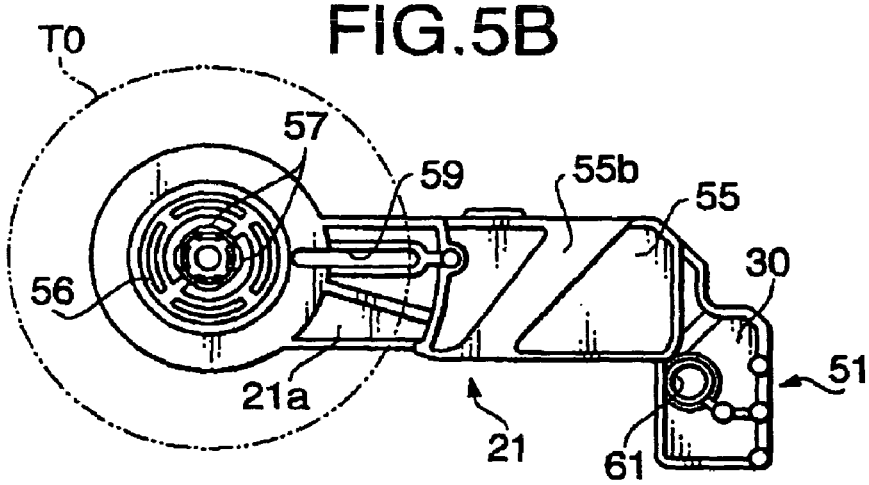
FIG. 5B is a bottom view of the tape unit.
Figure 6:
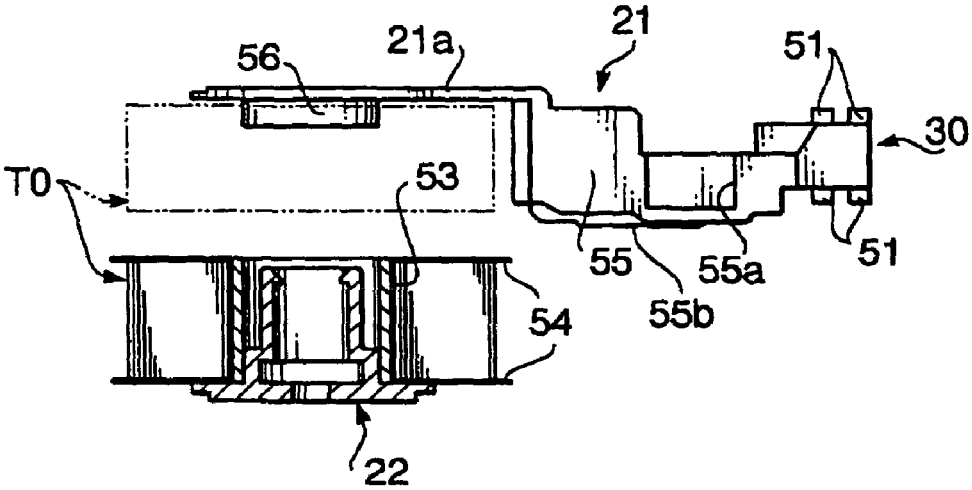
FIG. 6 is a side view showing the tape unit from which a lower spool has been removed.

In order to smoothly guide the print tape T (rolled up in the tape unit 20) to the thermal head guide section 37, tape guide walls 42 and 43 (in arcuate shapes as seen in a plan view) protrudes from the bottom of the cassette case body 32 (see FIGS. 2 and 4B). A pair of rectangular cavities 44 and 45 are formed on both sides of the tape guide walls 42 and 43, and an unshown photosensor (composed of a light-emitting device and a photoreceptor protruding from the cassette storage section 8) is fit in the rectangular cavities 44 and 45 so that the presence/absence of the print tape T passing through the tape guide walls 42 and 43 can be detected.

In right rear parts of the cassette case body 32 and the cassette cover 33, the tape detection parts 50*a* and 50*b* are formed, in which blocking parts 51 of the tape identification section 30 of the tape unit 20 (to be described later) are fit and set. For example, the tape detection part (50*a*, 50*b*) is composed of seven round holes, in which the blocking parts 51 protruding as round bars are selectively fit. From the tape detection part 50*a* on the cassette case body 32, a setting projection 52 in the shape of a round bar protrudes upward (see FIGS. 2 and 4B) for fixing the setting position of the tape unit 20.

As shown in FIGS. 2, 3, 5A, 5B, etc., the tape unit 20 is composed of the print tape T rolled up around a tape spool 53 (core tube), a support 21 which supports the upper edge of the print tape T, and a lower spool 22 which is inserted into the tape spool 53 from below for preventing the tape roll part T0 from slipping off. The support 21 made of synthetic resin includes a plate-like rotation support section 21*a* which extends outward to face and support the upper side surface of the roll part T0. The rotation support section 21*a* is formed to be slightly later (in radius) than a separator 54 (made of a resin film) whose radius is larger than the maximum radius of the roll part T0. From an end of the rotation support section 21*a*, a wall portion 21*b* connects the support section 21*a* and a junction section 55 (curving toward the lower side of the print tape T in the tape width direction) and the tape identification section 30 extend integrally.

The junction section 55 is provided with a guide groove 55*a* having a cross-sectional shape like "U" (see FIGS. 2 and 3) so that the lower edge of the print tape T pulled out from the roll part T0 can be guided toward the pair of tape guide walls 42 and 43.

In the cassette case body 32, the bottom of the tape unit storage section 41 is provided with seven ribs 41*a* protruding therefrom in a radial pattern. When the tape unit 20 is stored in the tape unit storage section 41, the roll part T0 of the print tape T is put on the ribs 41*a*. A part of the junction section 55 where the guide groove 55*a* is formed is thinned down in order to eliminate the level difference between the bottom of the guide groove 55*a* and the top of the ribs 41*a* and to let the print tape T pulled out from the roll part T0 run smoothly without vibrating in the tape width direction. In order to thicken and reinforce the thinned part of the junction section 55, a projecting part 55*b* projecting downward is provided to the underside of the thinned part.

At a part of the tape unit storage section 41 that faces the projecting part 55*b* when the tape unit 20 is stored in the tape unit storage section 41, an opening 46 capable of receiving the projecting part 55*b* is formed. When the projecting part 55*b* is inserted in the opening 46, the bottom of the guide groove 55*a* becomes substantially on the same level as the top of the ribs 41*a* of the tape unit storage section 41, by which the print tape T pulled out from the roll part T0 is allowed to run smoothly toward the guide groove 55*a* without vibrating in the tape width direction. In this state, the under surface of the projecting part 55*b* forms a single surface together with the under surface of the cassette case body 32, without protruding therefrom.

Figure 7:
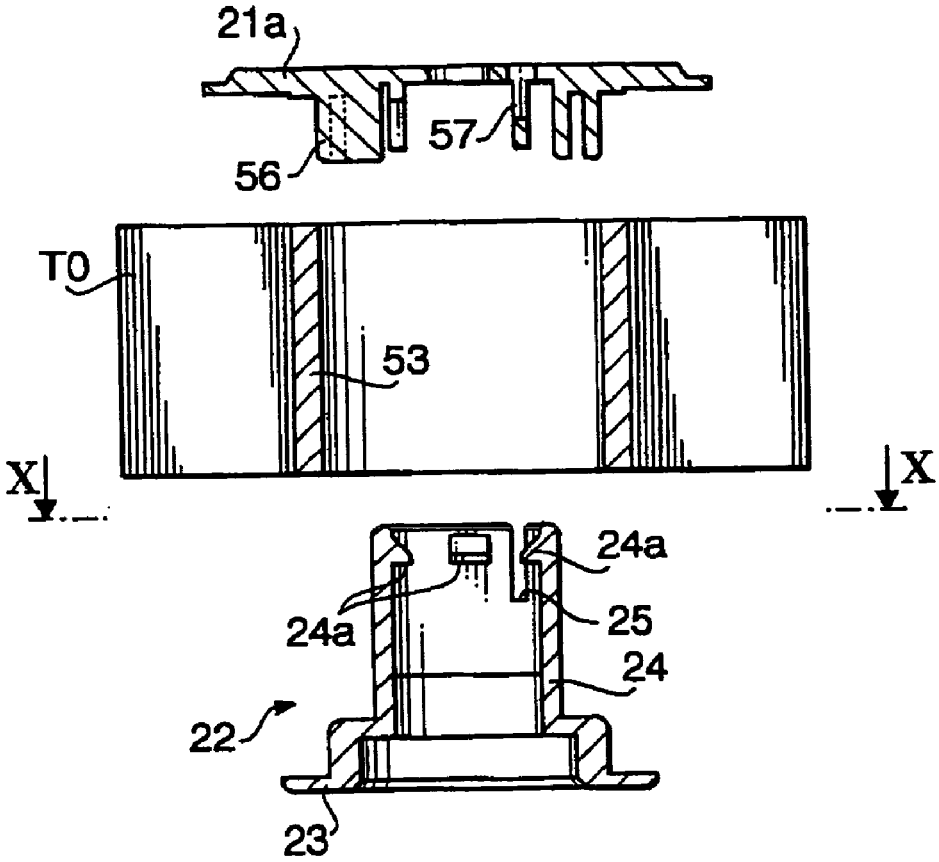
FIG. 7 is a cross-sectional view showing a rotation support section of the tape unit, a roll part of a tape, and the lower spool.
Figure 8:
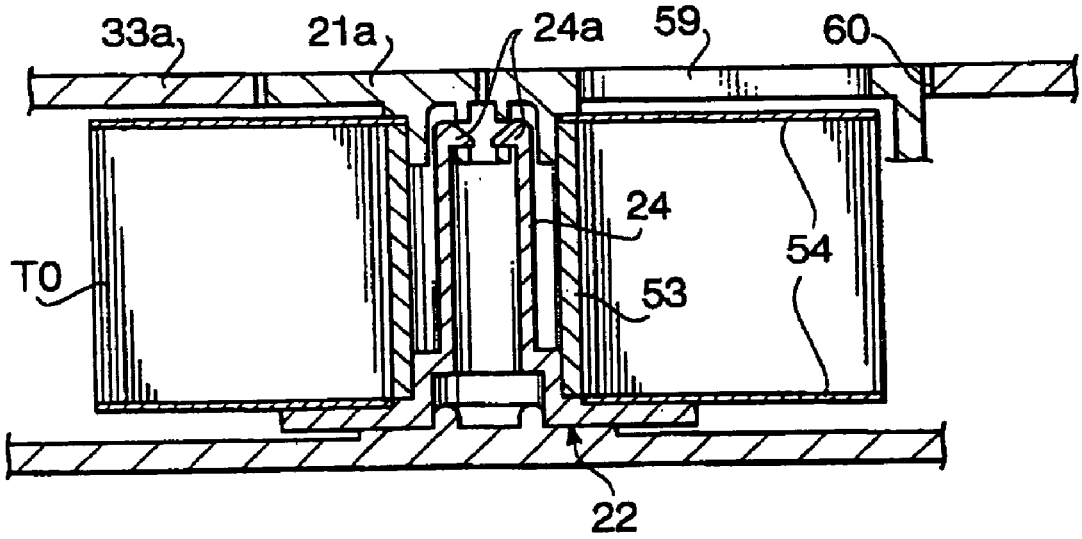
FIG. 8 is cross-sectional view showing the tape unit which is covered by the cassette cover, taken along the line VIII—VIII shown in FIG. 2.
Figure 9:
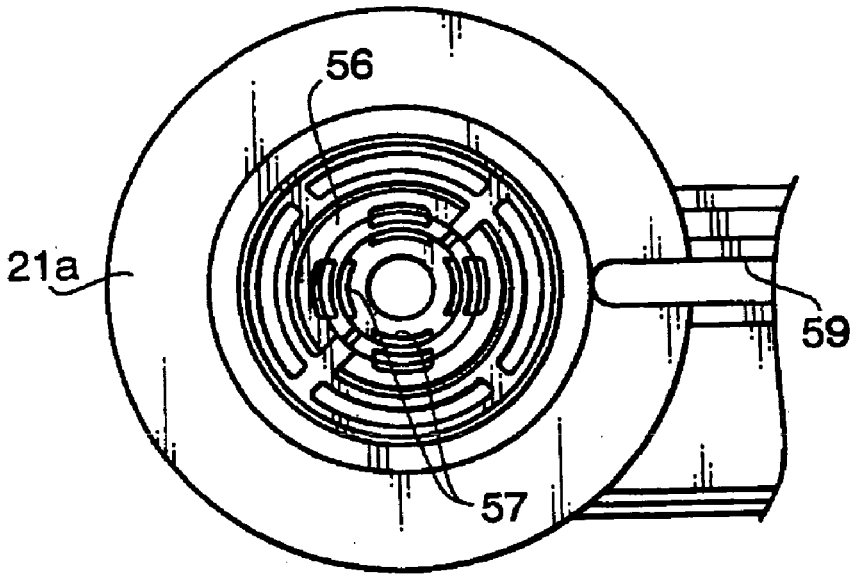
FIG. 9 is a bottom view of the rotation support section.
Figure 10:
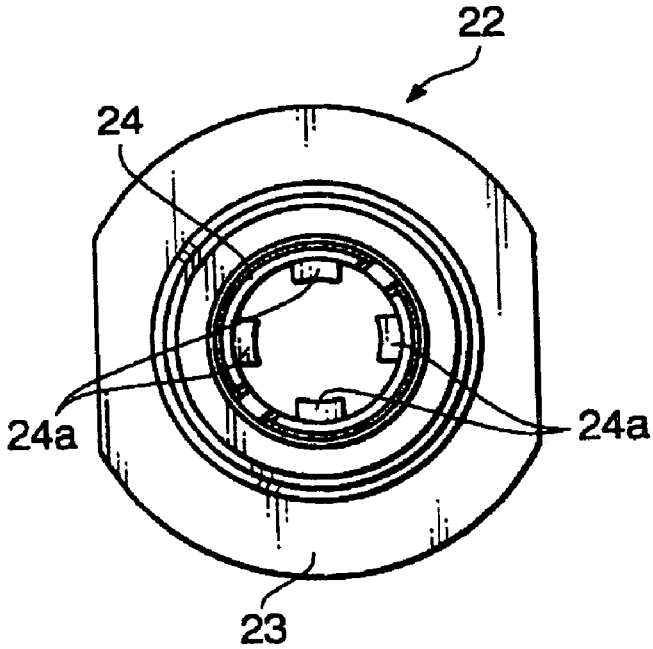
FIG. 10 is a plan view of the lower spool seen in the direction of the arrows X shown in FIG. 7.

On the under surface of the rotation support section 21*a*, a convex part 56, capable of fitting in the inner surface of the tape spool 53, is formed to protrude downward, and the rim of the convex part 56 is provided with a plurality of (four in this embodiment) latch holes 57 with which a plurality of (four in this embodiment) latches 24*a* of the lower spool 22 can be engaged (see FIGS. 7, 8 and 9). Meanwhile, in the lower spool 22 (see FIGS. 7, 8 and 10), the latches 24*a* are inwardly formed on the inner surface of a tube part 24 which protrudes upward from a flange part 23 of the lower spool 22. By inserting the tube part 24 into the tape spool 53 of the roll part T0 and letting the latches 24*a* engage with the latch holes 57, the lower spool 22 is firmly attached to the rotation support section 21*a* of the support 21, by which the roll part T0 is supported by the tube part 24 rotatably and undetachably. At the upper end of the tube part 24, a plurality of open grooves 25 are formed upwardly, by which the upper end of the tube part 24 narrows elastically when the latches 24*a* are engaged with the latch holes 57.

In the support 21 of the tape unit 20, the plate-like rotation support section 21*a* is provided with an observation window 59 which extends in the radial direction of the roll part T0. In this embodiment, the observation window 59 stretches inward almost to the rim of the convex part 56 so that the print tape T rolled up around the tape spool 53 can be seen up to its inner end, while stretching toward the junction section 55 so that the print tape T can be seen even when the roll part T0 has its maximum radius (when the print tape T has not been used yet).

An upper plate 33*a* of the cassette cover 33 is provided with a supporting section 60 by which the plate-like rotation support section 21*a* can be accommodated and supported firmly and through which the whole observation window 59 can be seen. In this embodiment, the rotation support section 21*a* is formed in a noncircular shape, and the supporting section 60 is formed as an opening in which part or all of the rotation support section 21*a* is fit firmly. As another example of the supporting section 60, it is possible to let part of the rotation support section 21*a* protrude upward and to provide the upper plate 33*a* of the cassette cover 33 with a supporting section 60 having an upward concavity for receiving the protrusion, forming the supporting section 60 by means of two-tone molding using a transparent material. It is also possible to provide the rotation support section 21*a* and the under surface of the upper plate 33*a* with one or more openings (unshown) and projections (for engaging with the openings) respectively while giving the upper plate 33*a* a window or opening (unshown) having the same shape and horizontal position as the observation window 59 of the rotation support section 21*a*. In either case, it is important that the whole observation window 59 can be seen from outside the cassette cover 33.

When the tape cassette 5 is stored in the cassette storage section 8 of the tape printing device 1, the bar-like blocking parts 51 protruding downward from the under surface of the tape identification section 30 of the support 21 selectively presses the microswitches of the tape type detection section. The width, type, etc. of the print tape T attached to the tape unit 20 can be detected based on on/off signals outputted by the microswitches which detects the number and positions of the blocking parts 51.

Incidentally, by providing the upper surface of the tape identification section 30 with the same number of blocking parts 51 at the same positions and letting them fit in the tape detection part 50*b* of the cassette cover 33, the support 21 of the tape unit 20 can be prevented from tilting, getting out of place, etc. Since a tape identification section 30 having no blocking part 51 is also possible, a registration hole 61 is previously bored through the tape identification section 30, and the setting projection 52 protruding upward from the tape detection part 50*a* of the cassette case body 32 is inserted in the registration hole 61 when the tape unit 20 is set in the tape unit storage section 41, by which the tape unit 20 can be set in correct position securely (see FIGS. 2 and 4B).

When the tape cassette 5 composed as above is loaded in the cassette storage section 8 of the tape printing device 1, the thermal head 12 installed in the cassette storage section 8 is positioned in the U-shaped concavity 38 of the thermal head guide section 37. In this state, the thermal head 12 is placed inside the tape cassette 5 and a plurality of heating elements of the thermal head 12 are positioned to face and contact a thermosensitive coloring layer of the print tape T (since the tape is rolled up around the tape spool 53 with the thermosensitive coloring layer facing inward as mentioned before).

When the tape printing device 1 is in operation, the platen roller 13*a* and the tape feed auxiliary roller 13*b* are positioned to face and press the thermal head 12 and the tape feed roller 11 respectively, by which the print tape T of the tape unit 20 stored in the tape unit storage section 41 of the cassette case body 32 is pulled out by the cooperation of the tape feed roller 11 and the tape feed auxiliary roller 13*b* and is smoothly guided to the tape pull-out section 36 through the tape guide walls 42 and 43, while characters (letters etc.) are printed on the thermosensitive coloring layer of the print tape T by the cooperation of the thermal head 12 and the platen roller 13*a* at the U-shaped concavity 38 of the thermal head guide section 37. Thereafter, the lettered print tape T (with the characters printed thereon) is ejected from the tape printing device 1 through the outlet 1*b* by the cooperation of the tape feed roller 11 and the tape feed auxiliary roller 13*b*.

Whether or not the print tape T rolled around the tape spool 53 (core tube) is running short/out by the creation of the lettered tapes (by the printing of characters on the thermosensitive coloring layer of the print tape T as described above) can be judged easily by observing the radius of the roll part T0 through the observation window 59 from above the cassette cover 33. When the print tape T ran out, the used tape unit 20 is replaced with a new tape unit 20 having a brand-new roll part T0 of the print tape T. For the replacement, the tape cassette 5 is took out of the cassette storage section 8 first. Subsequently, the engagement of the elastic hook 40 of the cassette cover 33 with the latch slot 39 of the cassette case body 32 is released by pressing a knob of the elastic hook 40 and the cassette cover 33 is removed from the cassette case body 32. Thereafter, the support 21 with the empty roll part T0 is removed from the tape unit storage section 41 together with the lower spool 22, and a new replacement tape unit 20 (having a brand-new roll part T0 of the print tape T) is stored in the tape unit storage section 41.

Since the top of the cassette case body 32 has become open (with the cassette cover 33 removed), the user holds the print tape T by its upper edge (upper in the tape width direction) pulls the print tape T out of the roll part T0, feeds the print tape T to the tape pull-out section 36 via the guide groove 55*a* of the tape unit 20 and the tape guide walls 42 and 43, and places the end of the print tape T at a position facing the tape feed roller 11.

At this stage the tape spool 53 and the roll part T0 of the print tape T have been set and supported by the support 21 and the lower spool 22 rotatably and undetachably as one piece, and the tape identification section 30 has been integrally provided to the support 21. Therefore, by returning the tape cassette 5 to the original position (in the cassette storage section 8 of the tape printing device 1) after replacing the tape unit 20 and feeding the end of the print tape T to the aforementioned position facing the tape feed roller 11, the tape printing device 1 is automatically enabled to carry out the judgment on the tape type etc.

As described above in detail, in the tape cassette 5 according to the above embodiment, the cassette case body 32 and the cassette cover 33 can be reused when the tape unit 20 is replaced, by which running costs of the tape printing device 1 can be reduced.

Incidentally, the print tape T employed in the above embodiment is composed of a base tape, the thermosensitive coloring layer formed on one surface of the base tape, and strippable paper which is stuck on the other surface of the base tape via an adhesive layer. Discoloration of the thermosensitive coloring layer can be prevented since the print tape T is rolled around the tape spool 53 with the thermosensitive coloring layer facing inward. For the roll part T0, the aforementioned separators 54 formed of PET (polyethylene terephthalate) films and the like are used for preventing the adhesive from oozing out of both edge faces of the roll part T0 (at both ends of the print tape T in the tape width direction) and sticking to the under surface of the rotation support section 21*a* of the support 21 and the upper surface of the flange part 23 of the lower spool 22, by which smooth rotation of the roll part T0 is ensured when the print tape T is pulled out.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

For example, while the cassette cover 33 was employed in the above embodiment, the tape cassette 5 can also be composed of the cassette case body 32 and the tape unit 20 only, without the cassette cover 33. It is also possible to form the rotation support section 21*a* of the tape unit 20 integrally with the cassette cover 33 in one piece.

While the cassette cover 33 was provided to be separable from the cassette case body 32 in the above embodiment, the cassette cover 33 can also be linked with the cassette case body 32 by use of the well-known hinge mechanism etc., letting the cassette cover 33 be openable/closable but undetachable from the cassette case body 32.

INDUSTRIAL APPLICABILITY

As set forth hereinabove, according to the present invention, in a tape cassette to be used for a tape printing device in which a tape unit having a print tape rolled up around a tape spool is exchangeably stored in a cassette case body, the tape unit is provided with a support including: a rotation support section which rotatably holds the tape spool and faces the roll part of the print tape; and a junction section which extends from the rotation support section, and a guide section for guiding the print tape pulled out from the roll part is formed on the junction section. Therefore, the attachment of the tape unit to the cassette case body can be completed by guiding the print tape pulled out from the roll part to the guide section on the junction section and attaching the tape unit in that state to the cassette case body, by which the attachment/replacement of the print tape (tape unit) can be made with extreme ease.

What is claimed is:

1. A tape cassette to be used for a tape printing device, in which a tape unit, including a print tape rolled up around a tape spool having opposite ends and being erected substantially in the vertical direction, is exchangeably stored in a cassette case body having a support surface for supporting said tape spool at one of said ends, wherein:

said tape unit includes a support including: a rotation support section which is formed at one of said ends of said tape spool opposite to the end supported by said support surface and holds said tape spool rotatably; and a junction section which extends from said rotation support section, a guide groove for guiding said print tape pulled out from a tape roll part is formed on said junction section, wherein said guide groove guides said print tape at one side of said print tape in a width direction, and further regulates said print tape in both directions perpendicular to a plane of said print tape, a projecting part for reinforcement being formed on the under surface of a part of said junction section where said guide groove is provided, wherein said guide groove traverses said junction section and said tape cassette case body has a receiving opening which receives said projecting part when said tape unit is stored in said cassette case body.

2. The tape cassette according to claim 1, wherein said rotation support section is provided with an observation window which extends in the radial direction of a tape roll part of said print tape.

3. The tape cassette according to claim 2, wherein:

said tape cassette comprises a detachable cassette cover which covers the top of said cassette case body, and said cassette cover is provided with a supporting section in which said rotation support section is fit immovably and through which an observation window can be seen.

4. The tape cassette according to claim 1, wherein a tape identification section, which identifies the type of said print tape rolled around said tape spool in cooperation with a detection device of said tape printing device, is formed in a part of said support next to said junction section.

* * * * *